US007874807B2

(12) United States Patent
Hill et al.

(10) Patent No.: US 7,874,807 B2
(45) Date of Patent: Jan. 25, 2011

(54) AIR COMPRESSOR WITH SHUT-OFF MECHANISM

(75) Inventors: Sean D Hill, Towson, MD (US); Lumin Li, Ellicott City, MD (US)

(73) Assignee: Black & Decker Inc., Newark, DE (US)

( * ) Notice: Subject to any disclaimer, the term of this patent is extended or adjusted under 35 U.S.C. 154(b) by 217 days.

(21) Appl. No.: 11/729,734

(22) Filed: Mar. 29, 2007

(65) Prior Publication Data

US 2008/0240933 A1 Oct. 2, 2008

(51) Int. Cl.
*F04B 41/06* (2006.01)

(52) U.S. Cl. ..... 417/2

(58) Field of Classification Search ..... 417/2, 417/44.2, 44.4, 44.5, 44.7, 44.8, 234, 426
See application file for complete search history.

(56) References Cited

U.S. PATENT DOCUMENTS

| | | | | |
|---|---|---|---|---|
| 720,719 | A | 2/1903 | Malstrom | |
| 2,256,654 | A * | 9/1941 | Spurgeon et al. | 417/234 |
| 2,620,412 | A | 12/1952 | Ford | |
| 3,226,836 | A * | 1/1966 | Bond | 33/701 |
| 3,726,606 | A * | 4/1973 | Peters | 417/7 |
| 3,937,912 | A | 2/1976 | Martin | |
| 5,104,295 | A | 4/1992 | Wong | |
| 5,700,956 | A * | 12/1997 | Huang | 73/735 |
| 6,427,530 | B1 * | 8/2002 | Krueger et al. | 73/152.46 |
| 7,004,032 | B2 * | 2/2006 | Lien et al. | 73/700 |

FOREIGN PATENT DOCUMENTS

| | | |
|---|---|---|
| CN | 2236129 Y | 9/1996 |

* cited by examiner

*Primary Examiner*—Charles G Freay
*Assistant Examiner*—Bryan Lettman
(74) *Attorney, Agent, or Firm*—Harness, Dickey & Pierce, P.L.C.

(57) ABSTRACT

A compressor system is disclosed, comprising a first pump driven by a D/C motor, a second pump driven by an A/C motor, and a switch which allows a user to manually selectively engage of one of the D/C motor or NC motor, including a gauge having a user settable shut-off mechanism which interrupts power to at least one of D/C or A/C motors. Also disclosed is a gauge configured to display system pressure independent of the user settable shut-off mechanism. A gauge having a rotatable bezel with a needle stop comprising a first needle rotatably coupled to a gauge shaft, and a second needle fixable coupled to the gauge shaft, and a spring disposed between the first and second needles, the spring configured to bias the first needle into the second needle so changes in pressure causes rotation of both is also disclosed.

11 Claims, 6 Drawing Sheets

AIR COMPRESSOR WITH SHUT-OFF MECHANISM

FIELD

The present disclosure relates to an air compressor and, more particularly, to an air compressor with a user settable automatic shut-off feature.

BACKGROUND

The statements in this section are merely background information and may not constitute prior art.

One of the main features of portable compressors is their ability to be used in diverse environments. Unfortunately, the availability of standard A/C or D/C power in these environments may be limited. To overcome this, compressors are typically driven by a D/C motor with associated circuitry which provides D/C power either from an A/C or a D/C input. The circuitry associated with input detection and conversion is often energy inefficient and expensive.

Another feature which is desirable is to control the output pressure on the compressor. Typically, systems have in-line gauges which are used to allow a user to monitor the output pressure of the compressor. Inattention on the part of the operator or a failure of a shut-off mechanism, however, may lead to over pressurization of the system.

SUMMARY

It is an object of the present invention to overcome the aforementioned disadvantages of the prior art. As such, disclosed herein is a portable compressor having a first compressor coupled to a D/C motor and a second compressor coupled to an A/C motor. The outputs of the first and second compressors are fluidly coupled to a gauge and an output hose.

In one embodiment, the system as described above has a gauge with a user settable shut-off mechanism that cuts power to both of the motors when the system pressure reaches a user settable level. In another embodiment, a compressor is disclosed having a gauge with a rotatable bezel having a needle stop. The shut-off mechanism is engaged when the needle interacts with the needle stop.

In yet another embodiment, a compressor system is provided which utilizes a gauge having a shut-off mechanism. The shut-off mechanism has a movable member which allows the user to set a cut-off system pressure. The gauge has a first needle rotatably coupled to a rotatable gauge shaft. A second needle is fixably coupled to the rotatable shaft. A spring is disposed between the first and second needles to bias the first needle into contact with the second needle, so that rotation of the gauge shaft in response to changes in pressure in the system causes rotation of both the first and second needles. A signal is provided to stop the compressor when the first needle interacts with or encounters the movable member. The first needle indicates pressure in the system irrespective of the location of the movable member, or the first needle.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
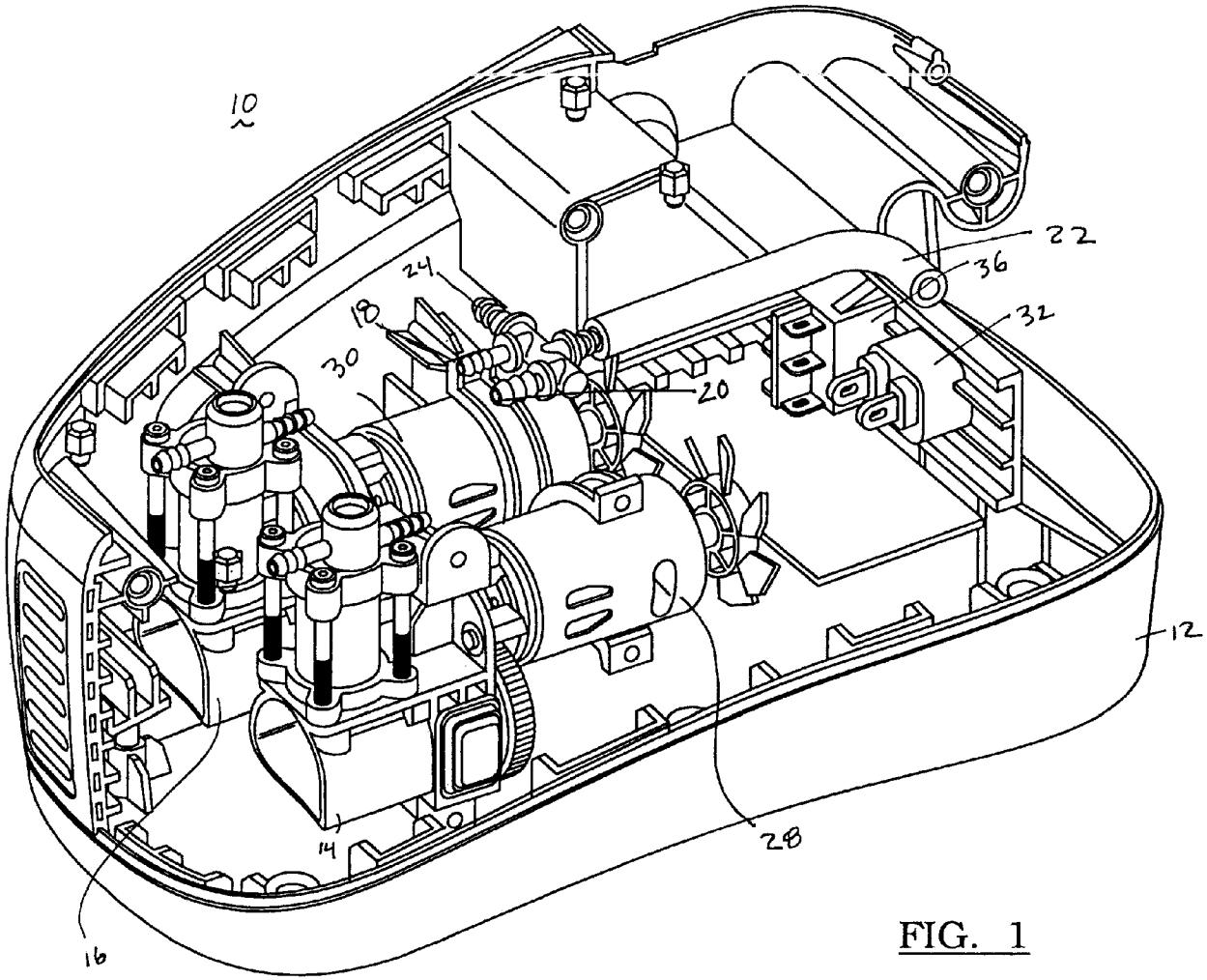
FIG. 1 represents a compressor according to the teachings of the present invention.

The following description is merely exemplary in nature and is not intended to limit the present disclosure, application, or uses. It should be understood that throughout the drawings, corresponding reference numerals indicate like or corresponding parts and features.

FIG. 1 represents a cross-sectional view of a compressor 10 according to the teachings herein. Disposed within an exterior housing 12 are first and second pumps 14 and 16. The piston driven air pumps 14 and 16 function to compress ambient air and provide it to an output hose 22. In this regard, the pump output ports 18 and 20 are fluidly coupled to the output hose 22 through a "Y" coupling adapter 24. Optionally, an accumulator or tank (not shown) can be disposed between the pumps 14 and 16 and the output hose 22.

Figure 2:
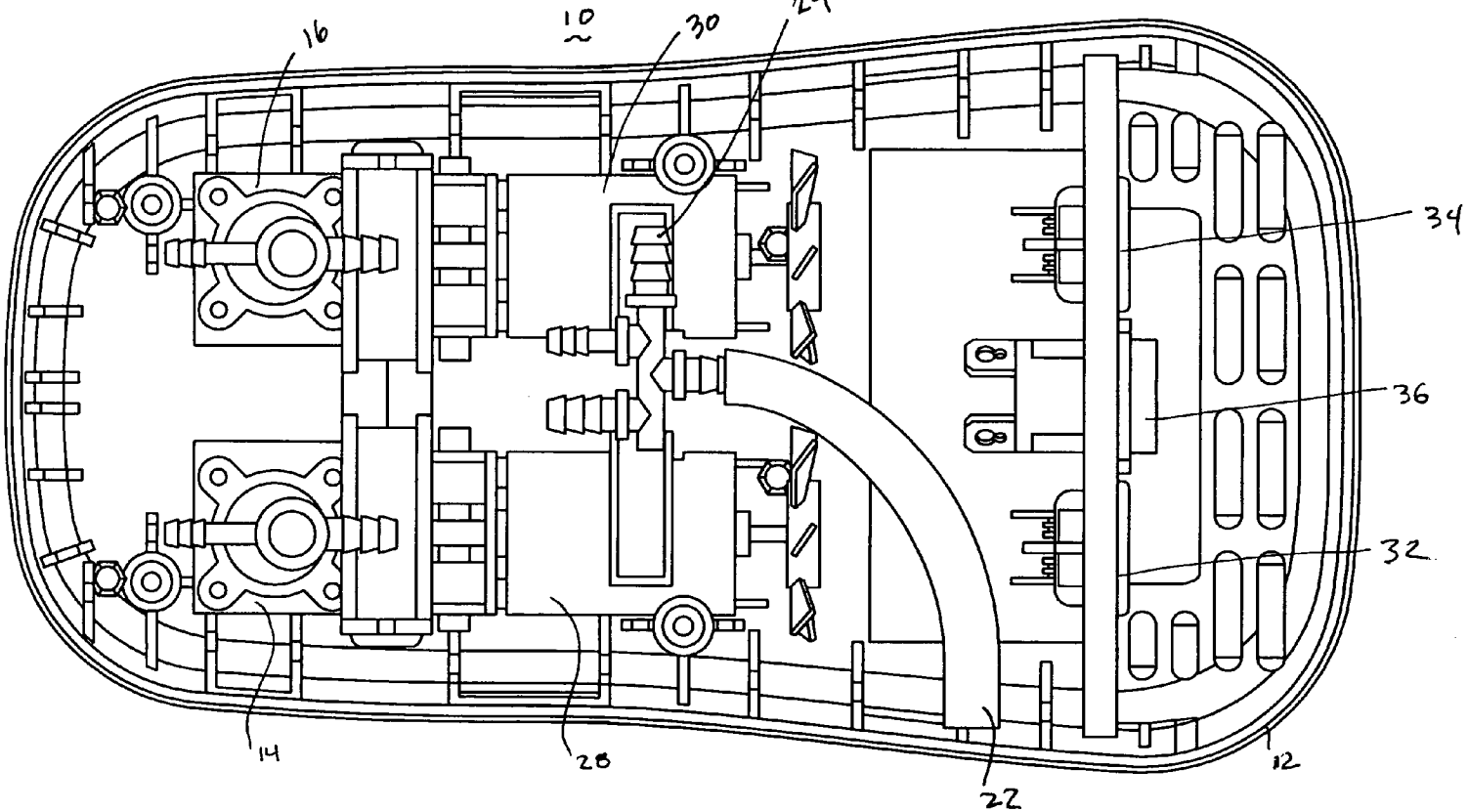
FIG. 2 represents a top cross-sectional view of the compressor shown in FIG. 1.
Figure 3:
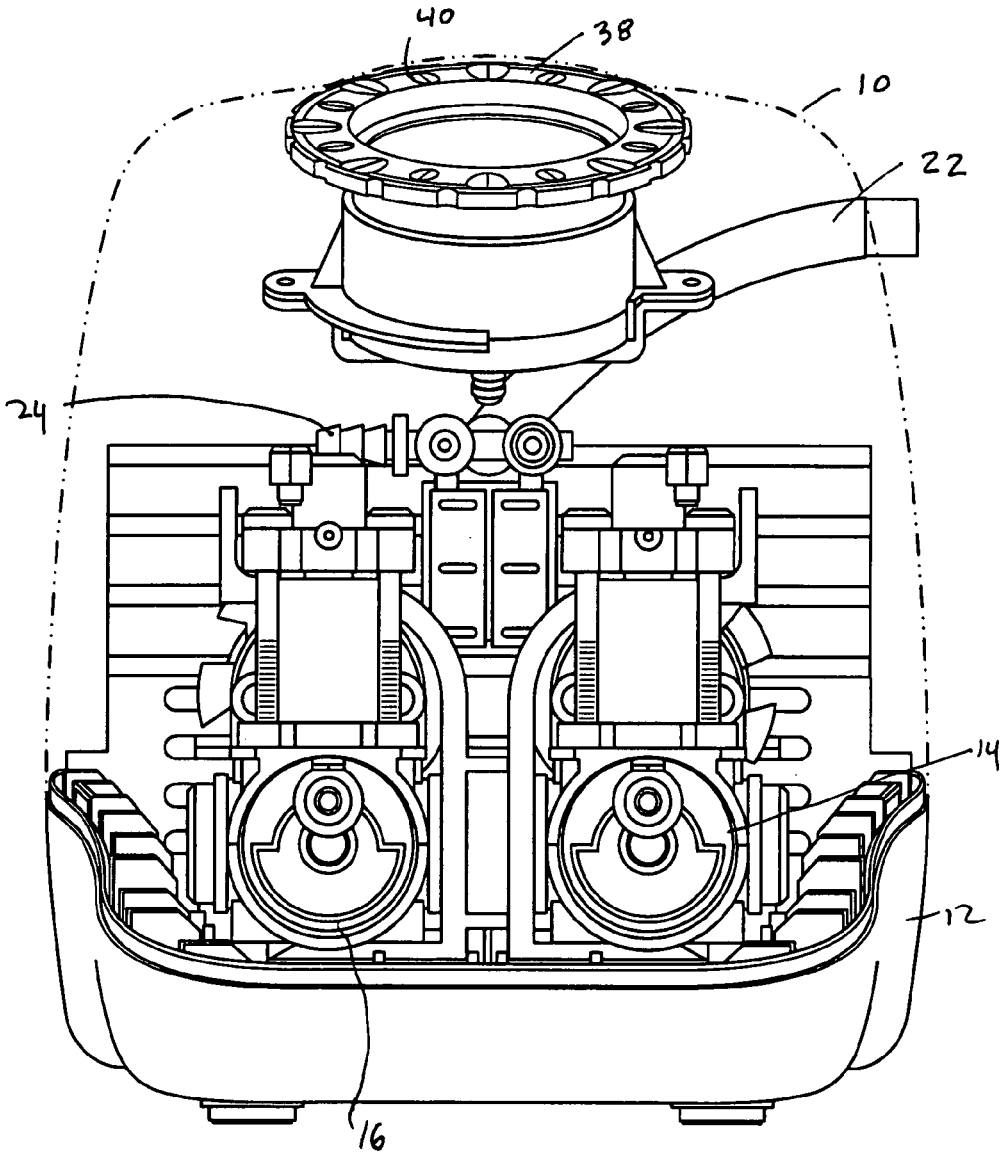
FIG. 3 represents a cross-sectional end view of the compressor shown in FIG. 1.

The first pump 14 is driven by a D/C motor 28, while the second pump 16 is powered by an A/C motor 30. As best seen in FIG. 2, the housing 12 has a pair of electrical supplies in the form of connectors 32 and 34. The first connector is configured to accept D/C power which is coupled to the first motor 28. It is envisioned that the D/C supply would provide power at between 3 and 24 volts. The second connector 34 is configured to provide A/C power to the second motor 30. The voltage of the A/C supply can be adjusted to accommodate international supply requirements. It is additionally envisioned the compressor can contain batteries and/or a transformer.

Disposed between the first and second connectors 32 and 34 is a three position switch 36. In a first position, the switch 36 functions to allow current flow from the first connector 32 to the first motor 28. The third position allows currents to flow from the second connector 34 to the second motor. The middle position is an off position that prevents current from flowing to either of the pump motors. In this particular configuration, only a single motor can be energized at a given time, even if both connectors 32 and 34 are coupled to power simultaneously.

Figure 4:
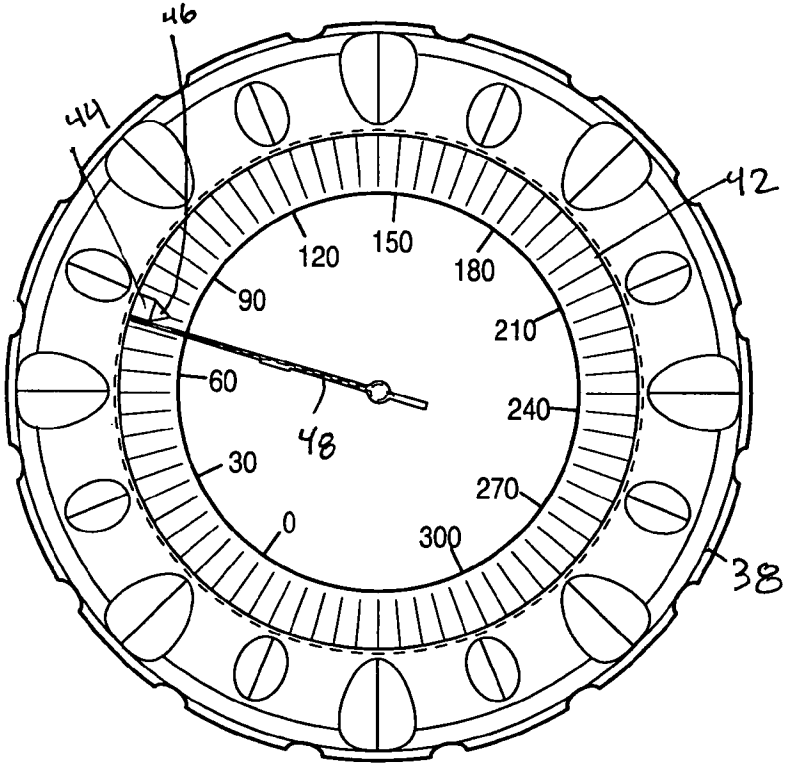

As shown in FIG. 4, the system additionally has a pressure gauge 38 which functions to measure system pressure achieved by either of the first or second pumps 14 and 16. The gauge 38, while measuring the air pressure within the system, also functions as a user settable shut-off mechanism. The gauge 38 has a user movable member in the form of a rotatable bezel 40. Disposed on an interior surface 42 of the bezel 40 is a stop 44. The stop 44 has an indicator 46 which the user can position at a desired cut-off pressure level 44'.

The gauge 38 allows the user to set a desired pressure in the system by cutting off power to one or both of the pumps once the gauge needle 48 engages the stop 44. Generally, the signal provided from the shut-off mechanism can be generated several ways. The needle 48 is coupled to a rotatable shaft 52 which rotates in response to changes in pressures in the system. In this regard, it is envisioned the engagement of the needle 48 with the stop 44 can function either as an open or closed switch. Additionally, it is envisioned that the bezel 40 can have a magnetorestrictive sensor which would sense movement of a magnetic member (not shown) disposed on the needle 48.

Figure 5:
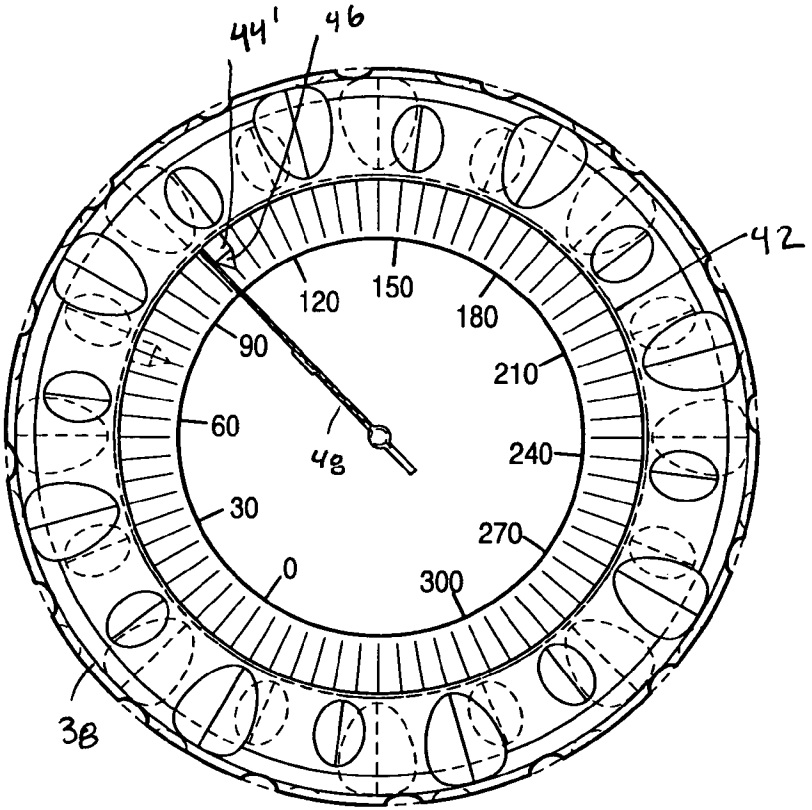
FIGS. 4 and 5 represent the use of the gauge shown in FIG. 3.
Figure 6:
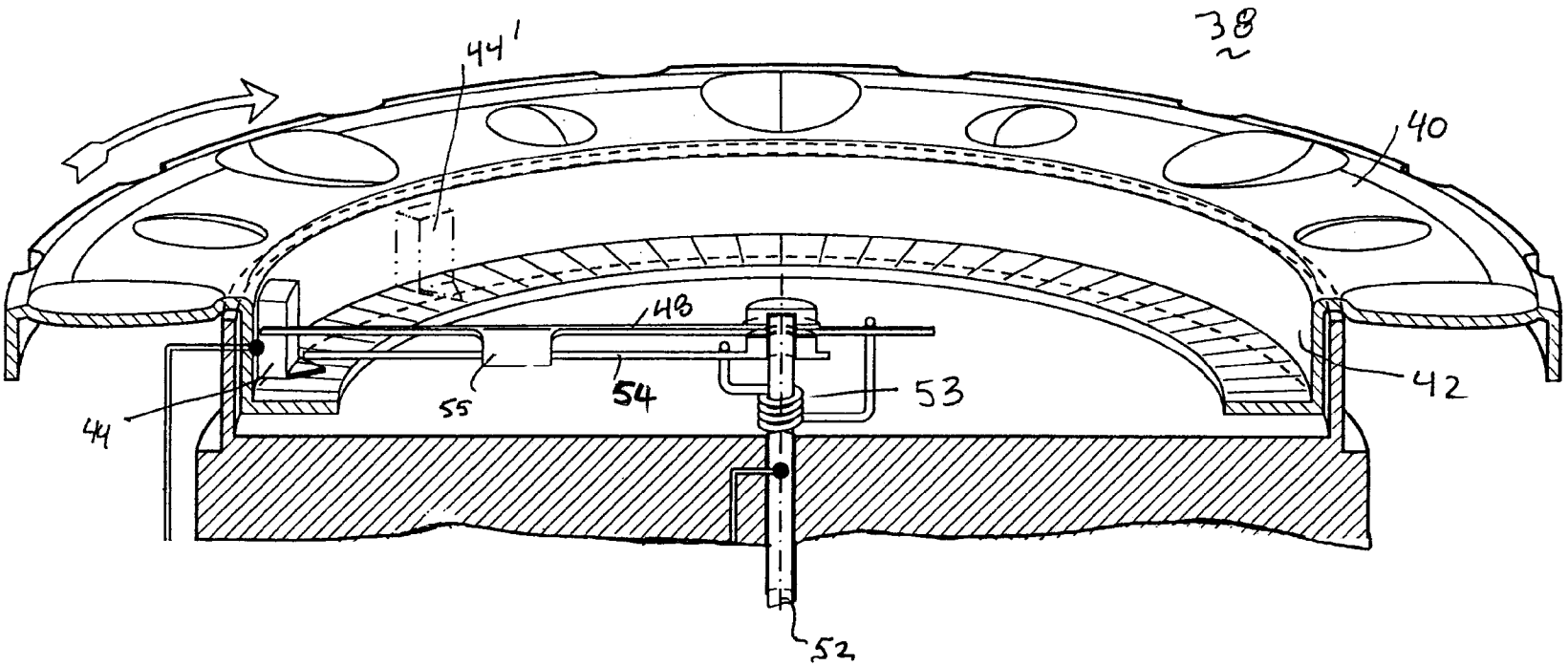
FIG. 6 represents a cross-sectional view of an alternate gauge.

The shut-off mechanism is configured to provide a signal which will be used by the system to interrupt power to one or both of the motors 28 and 30. As shown in FIGS. 4-6, rotation of the bezel adjusts the location of the stop 44 and, hence, the shut-off pressure. The needle 48 and stop 44 are electrically coupled to a power circuit so that when a needle 48 hits the stop 44, the circuit is closed and power to the pump motors is interrupted. Optionally, the needle 48 can form a short circuit across the power supply, driving the first and second motors 28 and 30. Additionally, the short can function to actuate a relay or transistor to cut-off power to the motors 28 or 30.

Optionally, the gauge 38 can be formed of a pair of needles 48 and 54 which are coupled to the shaft 52. The first needle 48 can be rotatably coupled to the shaft 52, while the second needle 54 can be fixably coupled to the shaft 52. Disposed between the first and second needles 48 and 54 is a spring 53 that rotatably biases the first needle 48 toward and into the second needle 54. Either one of the needles can have a flange 55 which allows the simultaneous rotation of the first 48 and second needles 54.

The first needle 48 is attached to the shaft 52 of the gauge by means of a bearing system so that it can float on the shaft 52. Travel of the first needle 48 is limited by the bottom range of the gauge 38 and the position of the stop 44 of the bezel 40. As described above, the first needle 48 can make electrical contact with the bezel's fixed stop contact 44 and can function to switch off the power to the pump motor. The first needle 48 is connected to the second needle 54 by means of the coil spring 53 in a manner that will hold it in position directly above the second needle 54. Travel of the second needle 54 is not limited by the bezel stop or contact 44.

Figure 7:
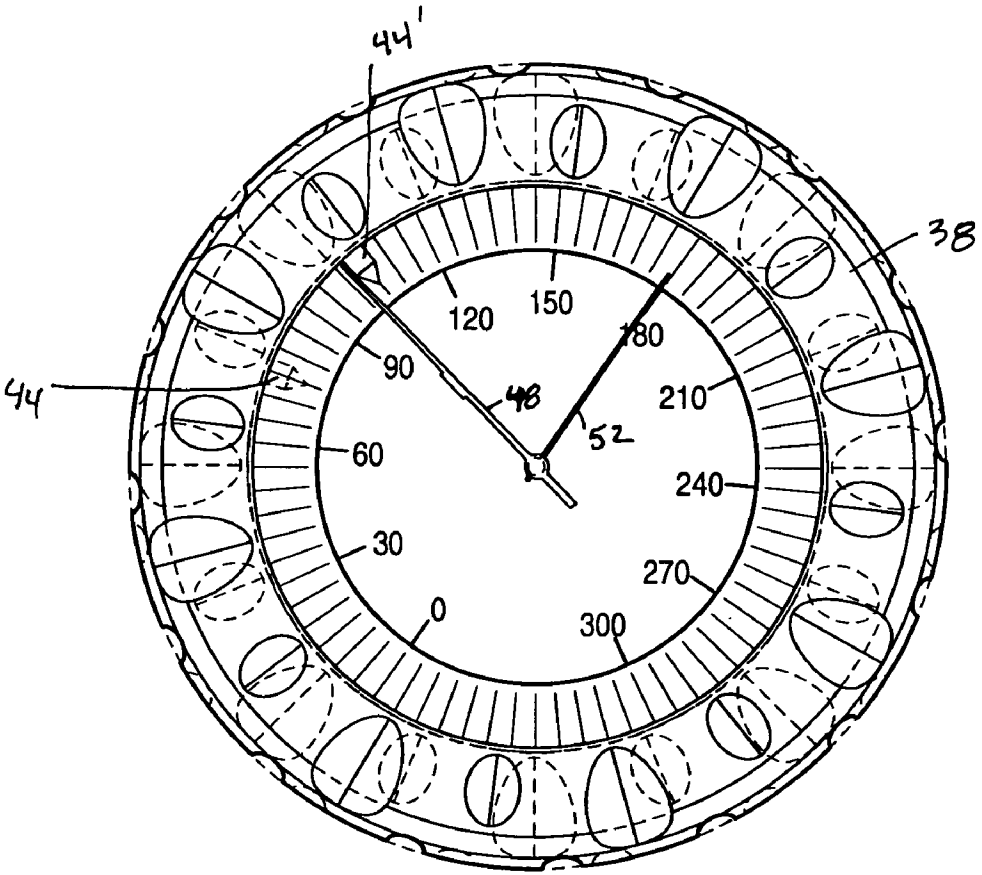
FIG. 7 represents the alternate gauge shown in FIG. 6.

As seen in FIGS. 6 and 7, the first needle 48 can have a length so as to allow interaction with the stop 44, while the second needle 54, which can be positioned below the first needle 48, is configured so as to allow it to move past the stop 44 to indicate the measured pressure in the system. If the compressor system should fail, and the pressure in the system goes above the bezel contact set location, the first needle 48 will stop at the bezel contact 44. In this position, the first needle 48 will float on the shaft 50 of the gauge 38. The second needle 54 will continue to move, showing that the pressure in the system is rising above the desired cut-off pressure. This condition will alert the user that the pump has not stopped or another failure condition has occurred, causing a higher than desired pressure in the system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A compressor system comprising:

a first pump having a first high pressure output, said first pump being driven by a D/C motor;

a second pump having a second high pressure output, said second pump being driven by an A/C motor; and a switch which allows a user to manually selectively engage one of the D/C motor or A/C motor and disengage a second of the D/C motor or A/C motor;

wherein said first and second high pressure outputs being fluidly coupled to a gauge having a gauge face and to a system hose, said gauge having a user settable shut-off mechanism which functions to interrupt power to at least one of D/C or A/C motors wherein the gauge comprises a rotatable bezel having a movable needle stop, said bezel being movable from a first position indicative of a first pressure to a second position indicative of a second pressure greater than the first pressure, with respect to the gauge face;

wherein the gauge comprises a first needle rotatably coupled to a rotatable shaft, and a second needle fixablv coupled to the rotatable shaft, said first needle being rotatable so that the first needle will engage the needle stop and actuate the shut-off mechanism, said first needle being biased toward the second needle via a first biasing spring and wherein the second needle is configured to indicate the pressure in the system greater than the second pressure;

wherein said first and second needles move together from the first position to the second position in response to an increase in pressure within the first pressure outputs.

2. The compressor system according to claim 1 wherein the shut-off mechanism provides a first signal when the first needle interacts with the stop.

3. The compressor system according to claim 1 wherein one of the first or second needles comprise a member which inhibits the movement of the second needle with respect to the first needle.

4. A compressor system comprising:

a gauge having a gauge face and a rotatable bezel with a needle stop, said needle stop being movable relative to the gauge face from a first position indicative of a first pressure to a second position indicative of a second pressure, said gauge further having a first needle rotatably coupled to a gauge shaft, and a second needle fixably coupled to the gauge shaft, and a spring disposed between the first and second needles, said spring configured to bias the first needle into the second needle so rotation of the gauge shaft in response to changes in pressure in an output line of the compressor system, causes rotation of both the first and second needles;

a first pump fluidly coupled to the gauge, wherein a user settable shut-off mechanism cuts power to the first pump when the first needle reaches the needle stop; and wherein the second needle is configured to display the pressure in the output line and wherein the second needle is movable to a third position indicative of a third pressure greater than the second pressure when the first needle has engaged the stop.

5. The compressor system according to claim 4 wherein the first needle engages the stop when the gauge shaft is rotated a predetermined amount.

6. The compressor system according to claim 4 wherein the second needle does not engage the needle stop.

7. The compressor system according to claim 4 wherein the first pump is driven by an A/C motor.

8. The compressor system according to claim 7 further comprising a second pump driven by a D/C motor, said second pump being fluidly coupled to the gauge.

9. The compressor system according to claim 8 comprising a D/C power supply.

10. The compressor system according to claim 9 comprising an A/C power supply.

11. The compressor system according to claim 10 comprising a switch which allows a user to manually selectively engage of one of the D/C motor or A/C motor and disengage a second of the D/C motor or A/C motor.

* * * * *